United States Patent [19]

Raymond et al.

[11] Patent Number: 4,632,051

[45] Date of Patent: Dec. 30, 1986

[54] SEA ANCHOR

[75] Inventors: F. P. Raymond, 184 Selleck St., Stamford, Conn. 06902; Frank V. Snyder, Greenwich, Conn.

[73] Assignee: F. P. Raymond, Stamford, Conn.

[21] Appl. No.: 734,460

[22] Filed: May 15, 1985

[51] Int. Cl.[4] ..... G01V 1/38

[52] U.S. Cl. ..... 114/311; 114/294

[58] Field of Search ..... 114/294, 300, 311

[56] References Cited

U.S. PATENT DOCUMENTS

| | | | |
|---|---|---|---|
| 300,764 | 6/1884 | Collins | 114/311 |
| 2,100,231 | 11/1937 | Armstrong | 114/311 |
| 2,466,692 | 4/1949 | Farrell | 114/311 |
| 2,861,534 | 11/1958 | Fehlner | 114/311 |
| 3,973,236 | 8/1976 | McLaughlin | 114/311 |

FOREIGN PATENT DOCUMENTS

| | | | |
|---|---|---|---|
| 2115362 | 9/1983 | United Kingdom | 114/311 |

OTHER PUBLICATIONS

Research Disclosure, Jun. 1981, No. 206, p. 241 National Maritime Institute of the United Kingdom.

*Primary Examiner*—Trygve M. Blix
*Assistant Examiner*—C. T. Bartz
*Attorney, Agent, or Firm*—Roland T. Bryan

[57] ABSTRACT

A sea anchor for a vessel, which is formed in a generally symmetrical configuration of a hollow and baseless truncated body or paraboloid with a wide mouth member at the edge of the cone base of strong material forming a hollow generally truncated body which is attached to a wide mouth strength member and in which the strong material has orifices in it so as to cause energy dissipation by the increased velocity therethrough and with the area of the orificial opening being not greater than 75 percent of the surface area of the truncated body and where the depth of truncated cone is such that the ratio of the diameter of the base of the body to the height or depth is in the range of 80 to 90 percent. The sea anchor of the invention has a bridal means attached to the wide mouth strength member arranged to have members meet at the longitudinal centerline of the cone for joining to a single anchor line from said vessel. The joining point the distance from the base of the body in the range of 1.8 to 2 times the diameter of the strength member at the base.

4 Claims, 2 Drawing Figures

FIG. 1.
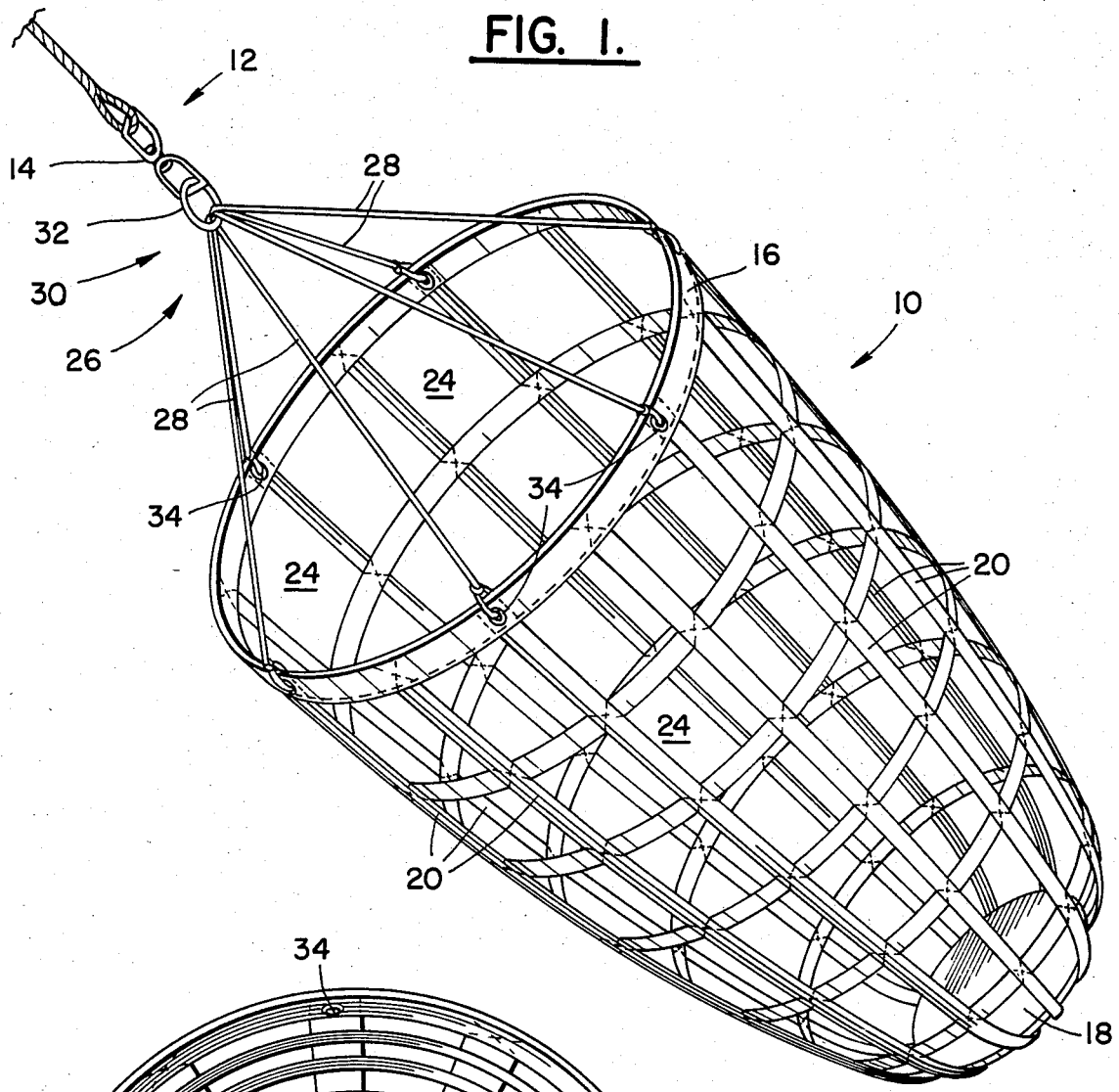
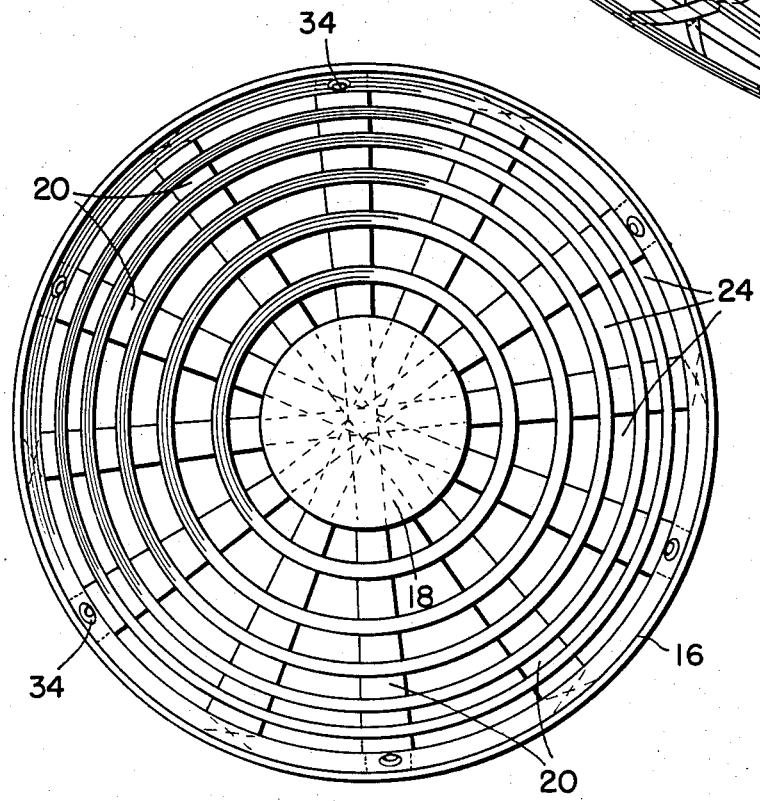
FIG. 2.

SEA ANCHOR

This invention relates to a class of devices which are used by vessels at sea to slow the drift of a vessel and to hold it into a desired attitude to the wind and sea that occurs when it encounters a gale, i.e., wind having speed in excess of 40 knots. Such devices for defining the invention herein could be generally called floating resistance bodies and include drogues that are streamed over the stern of a vessel and sea anchors which are streamed over the bow of the vessel.

PRIOR ART

It has been known to use various kinds of devices as floating resistance bodies that are tethered to a vessel and used in the circumstances where gale force winds blow across the sea to increase the wave motion and to increase the pressure on the vessel. The pressure on the vessel by high wind, when added the waves rolling under it, can cause it to broach or have its hull lie broadside to the waves. This constitutes a dangerous condition, for a breaking wave top can cause the vessel to roll over. As an additional hazard in these gale conditions, the vessel can be caused to move at high speed relative to the water and that high speed may drive it quickly towards land and endanger it. Such high speed can also result in instability of control with the possibility of the vessel turning over. Because of these conditions, seamen over many years were using either drogues or sea anchors, the primary purpose of which is to orient the vessel so that the narrow dimension of the bow and stern is presented to the wave and the wind so as to cause the least vessel motion and pressure thereon to allow the vessel to ride out the storm.

When a sea anchor is streamed over the bow so that the head of the vessel faces the oncoming wind and the waves, and when a drogue is streamed over the stern so that the end of the vessel faces the wind and the waves, the selection of which resistance body should be used depends upon the sea and navigation conditions characteristic of the vessel, and in addition, characteristics of the resistance body.

A sea anchor has been generally in the form of a hollow cone, the open face of the cone being pulled by straps or ropes to the oncoming water so that the resistance of the device to movement in the water is a caused by the large projected area of the open mouth base of the cone. The bridal means of the device is attached to a line going up to the vessel. At the apex of the cone, there may be a small hole therein and a line attached to that apex so that the vessel can attach a trip line to it and collapse the cone. The cone is made of a heavy canvas material to withstand strong pressures and may have a float attached to it to maintain it a certain depth below the surface of the water. Sea anchors are always streamed over the bow of the vessel that seeks to use it and are generally thought to be of a very high resistance so as to minimize the drift of the vessel through the water.

Another variant of the sea anchor is a very strong parachute where the bridal means comes down to a single point and then attach a line to the vessel. This device also has a trip line and a float.

Another type of sea anchor is one in which the device is formed in the shape of a pyramid and the open base is cross-braced with some kind of strength member so as to maintain its shape as it is being pulled through the water, and functions much the same as a conical or parachute type.

These sea anchors all have a recognized disadvantage in that they have a high resistance to being pulled through the water, so that when the vessel rises towards the top of a wave and is hit by the blast of high velocity air, a sudden force is caused to move the vessel backward relative to the water and the force is then passed along the line to the sea anchor. It can be extremely large and can cause damage by breaking the line, breaking the point of attachment to the vessel, or breaking the anchor itself. Moreover, as the resistance to movement is constant and strong, the force that is imposed upon the line of the vessel can be extremely large and result in damage. Also, due to the high force characteristics, these devices are often marked with a caution not to use in hurricane-force winds. Thus when a device is really needed, it becomes too dangerous to use.

Other seamen, when faced with gale conditions, prefer to use a resistance body as a drogue which is streamed over the stern of the vessel. In prior known devices, it can consist of things as simple as a mass of sails and/or spars all wrapped together. It has also been known for fishermen to take their large fishing nets and sling them over the stern so as to keep the stern to the breaking seas. Such drogues are uncertain of performance and have been known to be uneven due to surfacing and, at times, have been thrown on board the vessel by breaking seas.

THE PRESENT INVENTION

This invention is based on the insight that a resistance body needed to slow the vessel's drift should have an initial high resistance, but the resistance should not be so high or last so long that it causes excessive strain on either the tethered line or the vessel itself. And further, that after the initial surge of the vessel is transmitted to the device, it should be able to relieve that initial high strain on the line while continuing to create high resistance and thus dissipate the energy that is being placed upon the vessel by the wind and the sea. In particular, it is a concept here that by making the sea anchor with orifices therein in the sides of the device that when it is caused to be dragged through the water at higher velocity, the fluid passing through the orifice will have its velocity increased relative to the velocity of water entering the sea anchor, and as energy dissipation under such conditions is a function of velocity to the second power, the faster the sea anchor goes through the water, the greater will be the energy dissipated by the orifices.

The new invention is a sea anchor for a vessel, which is formed in a generally symmetrical configuration of a hollow and truncated three dimensional body or paraboloid with a wide mouth member at the edge of the body base of strong material forming a hollow generally truncated cone which is attached to a wide mouth strength member and in which the strong material has orifices in it so as to cause energy dissipation by the increased velocity therethrough and with the area of the orificial opening being not greater than 75 percent of the surface area of the truncated body and where the depth of truncated body is such that the ratio of the diameter of the base of the cone to the height or depth is in the range of 80 to 90 percent. The sea anchor of the invention has a bridal means attached to the wide mouth strength member arranged to have members meet at the longitudinal centerline of the body for joining to a single anchor line from said vessel. The joining point the distance from the base of the body in the range of 1.8 to 2 times the diameter of the strength member at the base.

The invention also contemplates that the sea anchor will have a high initial resistance to movement and good longitudinal stability due to the fact that the truncated end of the sea anchor has an imperforate end and such imperforate area, as compared to the area of the open base of said truncated body, will be in the range of 15 to 25 percent of such projected base area.

A further aspect of the invention is that the aforesaid sea anchor will be of different sizes depending on the displacement of the vessel to which it is to be attached. The size will be one (1) cubic foot of sea anchor for each 2600 pounds of displacement.

More particularly, a sea anchor of the type described will have a multiplicity of circumferentially uniformly spaced longitudinal strength webs attached to and extending between the open base strength member and the imperforate member. It will also have a number of substantially uniformly spaced longitudinally spaced webs arranged transverse to said longitudinal webs to form therewith a grid so that the orificial openings therein are generally rectangular.

The improved sea anchor gains its characteristics from a unique combination of multiple orifice velocity increase and high drag coefficient form.

A DETAILED DESCRIPTION OF THE INVENTION

In order for those skilled in the art to understand how to make and use the invention, there is set forth hereinafter a detailed description of the preferred embodiment of the invention, which is merely exemplary. In the Figures:

FIG. 1 is a side view of the sea anchor; and

FIG. 2 is an end view of the sea anchor to illustrate its details of construction.

A resistance body for attachment to a vessel for use in gale-force conditions and above, is illustrated in the Figures in which the sea anchor 10, shown as attached to an anchor rode 12 by a swivel fitting 14, in turn is attached to bridal means 26 at a point identified in FIG. 1 as 30. Thus the invention is shown in the mode in which it is tethered to vessel needing same by the anchor rode 12 and is arranged so that in looking at FIG. 1, it would move through the water relative right to left.

The sea anchor of the invention as illustrated in FIG. 1, is a three dimensional body having the general shape of a truncated cone but it could be more precisely described as a three-dimensional body of rotation of a parabola, i.e. a paraboloid. The "truncated body" term will be used to encompass all of the shapes of hollow three-dimensional bodies in which the base has a larger major diameter or transverse dimension than the peak or top part of the body, with the outer surface slanting inwardly from perimeter of the base at an acute angle. It is contemplated by the invention here that the imaginary surface of the sea anchor runs in a generally longitudinal direction and shall also be generally slanted inwardly terminating at an impeforate truncated end or peak as shown in FIG. 1 as 18. This end piece is termed the second strength member 18 at one end of the sea anchor, is arranged so that it is imperforate, it is of such a size that its cross-sectional area projected to larger area of the body base and to the water entering the sea anchor, and is in the range of 15 to 25 percent of such area. The purpose of this imperforate section is to provide a large resistance area to the straight line water flow entering the sea anchor, and, secondly, to have a high-strength section to which the construction described hereinafter can be applied in a strong manner.

As shown, the wide mouth strength member 16 is in the form of a circle, preferably would be a ring or a flexible cable, covered by a strong cloth member. Accordingly, the strength member is generally of a uniform weight throughout its perimeter so the weight distribution is symmetrical. Running between the large open mouth member 16 and the imperforate strength member 18 is a large number of longitudinal webs 20 arranged so that they are attached to both of those members at circumferentially uniformly spaced positions. A number of substantially uniformly spaced longitudinally spaced webs 22 are arranged transverse to the longitudinal webs so that when attached thereto they form a grid with rectangular orifical openings 24 that are uniformly distributed throughout the side of the sea anchor as shown. In arranging such webs or straps their broad faces lie in the plane of the surface of the cone and transverse to the flow water. Of course, as the sea anchor illustrated is to be deployed, it has attached to the large strength member 16 a bridal 26 consisting of a number of straps or ropes which come to a common point at 30, in which there is fixed a ring 32 for attachment to the swivel 14.

A specific embodiment of a sea anchor made in accordance with the present invention has the base strength member or ring 16, that is forty one inches in diameter, a diameter of the second strength member 18, being eighteen inches with the longitudinal length of the sea anchor being forty eight inches. The longitudinal members, webs 20, and the transverse or circumferential webs 22 are made from two inch wide webbing of the type that is used in construction and have a load carrying ability of approximately 10,000 pounds. The horizontal webs 22 are spaced from each other by about eight inches, except for the one that is closest to the ring 18 and that is spaced nine inches thereform. The longitudinal members 20 are spaced from each other so that they are on nine inch centers. The bottom strength member 18 consists of three layers of nine ounce high strength cloth, with the ends of the webs held therebetween and firmly attached by sewing. The upper ends of the longitudinal webs 20 are held by a cloth that is wrapped around the strength member 18 and over the ends of the webs and securely sewn thereto with a grommet 34 passed through. The grommets allow ropes or webs 28 to be passed around the strength member 16 and securely fastened to itself. As illustrated, there are seven rope legs, with a rope length of seventy seven inches after securing. Each of those ropes are arranged so that they passed from the grommet on one side of the sea anchor to the other side, and pass then through the ring 32. When they have all been passed therethrough, then there is a seizing that they are all held tightly together by small lines.

The strength member 16 which lies at the base of the truncated cone in the model specifically described has as its basic strength member $\frac{3}{8} \times 1 \times 19$ layed cable, the ends of which are fastened to each other by a butting-type of sleeve that is pressed thereon in a manner known in the art.

A sea anchor made in accordance with the invention as specifically set forth hereinabove, was streamed to the stern of a vessel having a displacement of about 25 tons, during a storm in the Gulf Stream wherein the wind was blowing at force 10 and generating very confused and steep seas. The result was the vessel changed from one which was running before the sea with no sails on its mast at speeds that ranged from 3 knots on the back side of the wave to 10 knots when the vessel went down the front of the wave. The vessel was so uncontrollable that as the wave rolled under it it would catch it and roll the vessel such that the rail went under water—in other words, it was impossible to control the vessel. However, after the sea anchor of the present invention was streamed over the stern, there was no strong sudden surge or high load on the anchor line and the speed of the vessel very quickly was reduced to approximately 3 knots under which conditions the vessel answered its helm, it stayed upright and the helmsman found that he could steer the vessel within a 90-degree quadrant. The sea anchor did not come out of the water, and it maintained a constant drag on the vessel.

The sea anchor configuration as shown in FIG. 1 is characterized by the fact that it is stable, that is, it will maintain its constant relative position to the sea as it is dragged through the water, and thus has a continued resistance through the water to hold the vessel to which it is attached, in a proper attitude to the sea and the wind. Because of the large projected area of the peak or apex of the sea anchor compared to its open mouth, it has a high initial resistance to sudden impositions of pulling on the line, such that the resistance to movement is very high when there is a sudden pull by the ship on the line, but as soon as the device starts moving, the water starts flowing through the orifices 24 thereof and the resistance drops. Then as the large body of water is broken up into many streams that are accelerated through each of these orifices as the vessel gains speed, the water is accelerated to a higher velocity than when entering the orifice, yielding an energy loss that is proportional to the square of the velocity change, plus the fact that the surface-to-volume relationship of the water passing therethrough is increased so that the skin friction portion of energy loss on the actual body of the sea anchor is increased over an equivalent imperforate cone of the same dimension.

It is believed that the stability of the sea anchor is maintained when the area of the strength member 18 has an area that is 15 to 25 percent of the projected area of the open ring 16. In addition to contributing to stability as the sea anchor is dragged through the water, the diameter of the ring 16 should be in the range of 80 to 90 percent of the diameter of the strength member 18.

An additonal benefit of the particular form and material of the improved sea anchor is extreme stability, so much so that it is most appropriate for retrieving a person from the water and bringing him aboard. A second person can even be prepositioned in the sea anchor to assist in the rescue of a disabled man overboard.

The imperforate areas or truncated end 18 of the body may have a single high strength attachment point or opening to attach a line for additional control during man overboard rescue operation.

The resistive power of the device is a function of its size. There are different sizes of sea anchors for different displacement of vessels and there is shown hereinbelow a Table I which depicts the vital dimensions of sea anchors made according to the present invention in terms of the diameter of the ring 18 to the depth of the sea anchor, projected face area of the inside of the diameter of the strength member 16, the outer surface areas, and the volume contained within the truncated cone, all as related to ship displacement.

TABLE I

| Diameter & Depth | Projected Area | Surface Area | Volume | Ship Displmt. |
|---|---|---|---|---|
| 24 × 28 | 3.14 ft. 2 | 6.42 ft. 2 | 3.89 ft. 3 | 10,200 lbs. |
| 30 × 35 | 4.91 ft. 2 | 9.16 ft. 2 | 7.55 ft. 3 | 19,800 lbs. |
| 36 × 42 | 7.07 ft. 2 | 12.9 ft. 2 | 12.98 ft. 3 | 34,100 lbs. |
| 41 × 48 | 9.17 ft. 2 | 16.12 ft. 2 | 19.03 ft. 3 | 50,000 lbs. |
| 48 × 56 | 12.57 ft. 2 | 21.80 ft. 2 | 30.59 ft. 3 | 80,300 lbs. |
| 54 × 63 | 15.90 ft. 2 | 27.08 ft. 2 | 43.18 ft. 3 | 113,500 lbs. |
| 60 × 70 | 19.63 ft. 2 | 34.06 ft. 2 | 59.56 ft. 3 | 156,500 lbs. |
| 72 × 84 | 28.27 ft. 2 | 49.96 ft. 2 | 102.70 ft. 3 | 269,800 lbs. |

It can be seen that the ratio of the ship displacement to the sea anchor volume shows that for every 2600 pounds of displacement there would be needed approximately 1 cubic foot of volume of the sea anchor with the configuration of the orificial opening in the sea anchor being proportionally increased as described above.

The advantage of this particular type of sea anchor over any prior models is the concurrence of two special characteristics; a very low resistance to acceleration and a very high resistance to high speed while maintaining its hydraulic stability. The result is a very controlled low speed in which the controlled vessel is subject to the least strain from the wind, waves or the sea anchor itself.

Although the sea anchor has been described as being made up from straps, it should be borne in mind that the invention contemplates that orifices can be placed and controllably sized in the side of the surface of the truncated cone of the improved sea anchor as is desired for the sea conditions and vessel intended. Thus, other means of construction may be used to obtain the orifices between the strong surface sections of the sea anchor without departing from the spirit of the invention. Moreover, it will be evident to those skilled in the art that changes in details of construction without departing from the principles of the invention.

We claim:

1. A new sea anchor for a vessel of a generally symmetrical geometric configuration as a hollow and truncated three dimensional body in which there is a base having a greater major transverse dimension than the transverse dimension of the truncated peak thereof and with an outer surface slanting inwardly from the base perimeter at an acute angle and having (a) a wide mouth bottom with a strength member at the perimeter of the body base, said member being of a generally uniform weight throughout its perimeter, (b) a strong material forming said outer surface of and said hollow generally truncated body attached to said wide mouth strength member and having orificial openings through said material to cause energy dissipation by the increased velocity thereof, said orificial openings being uniformly distributed throughout said outer surface between said base and peak, (c) the area of said orificed openings being not greater than 75 percent of the surface area of said truncated body, (d) the ratio of the major transverse dimension of the base of the truncated body to the height being in the range of 80 to 90 percent, (e) a bridal means attached to said wide mouth strength member arranged to meet at the longitudinal center line of said body and projecting in a direction opposite to said peak for joining to a single anchor line of said vessel with said meeting point being a distance from said strength member in the range of 1.8 to 2 times the diameter of said strength member, and (f) said truncated peak end thereof is a second strength member and has no orifices and the area thereof is in the range of 15 to 25 percent of the projected transverse opening area of the base of said truncated hollow body whereby the anchor, having the dimensional relationships specified, is hydrodynamically stable as it is dragged through the water.

2. A sea anchor according to claim 1 in which the truncated body volume is in proportion to the displacement of the vessel for which it is intended and is about 2600 pounds of displacement per cubic foot of sea anchor volume.

3. A sea anchor according to claim 1 in which said strong material forming hollow truncated body comprises:

(a) a multiplicity of circumferentially uniformly spaced longitudinal strength webs attached to and extending between said strength members, and (b) a number of substantially uniformly spaced longitudinally spaced webs arranged transverse to and attached to said longitudinal webs to form a grid so that said orificial openings are general rectangular.

4. A sea anchor according to claim 3 in which each of said webs are of a strap-like configuration with their broad faces lying in the plane of the surface of said body to create broad resistance bonds to movement of water through the water.

* * * * *